US009241386B2

(12) United States Patent
Fukuda et al.

(10) Patent No.: US 9,241,386 B2
(45) Date of Patent: Jan. 19, 2016

(54) LIGHTING APPARATUS AND ILLUMINATION SYSTEM USING THE SAME

(71) Applicant: Panasonic Corporation, Osaka (JP)

(72) Inventors: Kenichi Fukuda, Osaka (JP); Masahiro Naruo, Osaka (JP); Sana Esaki, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/463,989

(22) Filed: Aug. 20, 2014

(65) Prior Publication Data

US 2015/0084534 A1 Mar. 26, 2015

(30) Foreign Application Priority Data

Sep. 25, 2013 (JP) ..... 2013-198669

(51) Int. Cl.
*H05B 33/08* (2006.01)

(52) U.S. Cl.
CPC ..... *H05B 33/0866* (2013.01)

(58) Field of Classification Search
CPC .... H05B 37/02; H05B 33/08; H05B 33/0815; H05B 33/0833; H05B 33/0845; H05B 33/0851; H05B 33/0866; H05B 33/0809
USPC ..... 315/200 R, 201, 209 R, 210, 224, 291, 315/297, 299, 307, 308
See application file for complete search history.

(56) References Cited

U.S. PATENT DOCUMENTS

2010/0007292 A1* 1/2010 Horino ..... H05B 37/029 315/312
2010/0148703 A1* 6/2010 Mizuno ..... H05B 33/0818 315/312
2010/0225241 A1* 9/2010 Maehara ..... H05B 33/0863 315/250

FOREIGN PATENT DOCUMENTS

JP 2009-076380 A 4/2009
JP 2009-117080 A 5/2009
JP 2010-176984 A 8/2010
JP 2010-176986 A 8/2010
JP 2011-171179 A 9/2011

* cited by examiner

*Primary Examiner* — Thai Pham
(74) *Attorney, Agent, or Firm* — Renner, Otto, Boisselle & Sklar, LLP

(57) ABSTRACT

A lighting apparatus includes a power supply unit and a control unit configured to control the power supply unit. The control unit determines, at a time of activation of the lighting apparatus, a first color temperature of the load at an initial stage of lighting based on a command value. Thereafter, the control unit controls the power supply unit such that the light quantity and the color temperature of the load change according to a second output characteristic during a period in which the color temperature of the load changes from the first color temperature to a second color temperature. The second color temperature is a color temperature, in the first output characteristic, corresponding to the command value. A correspondence relationship between a plurality of light quantities and a plurality of color temperatures defined by the second output characteristic is different from that of the first output characteristic.

20 Claims, 4 Drawing Sheets

LIGHTING APPARATUS AND ILLUMINATION SYSTEM USING THE SAME

CROSS-REFERENCE TO RELATED APPLICATION

This application claims the benefit of priority of Japanese Patent Application Number 2013-198669, filed on Sep. 25, 2013, the entire contents of which are hereby incorporated by reference.

TECHNICAL FIELD

The disclosure generally relates to lighting apparatuses and illumination systems using the same, and more particularly, relates to a lighting apparatus that performs dimming and color adjustment of a load including a light-emitting element and an illumination system using the same.

BACKGROUND ART

Heretofore, various color temperature variable illumination apparatuses in which the light color (color temperature) of the illumination light is adjustable have been provided, and an example thereof is disclosed in JP 2010-176986A (hereinafter referred to as "Document 1"). The color temperature variable illumination apparatus described in Document 1 includes an illumination light source including a plurality of light sources each having a different light color, and a drive means that causes each of the plurality of light sources to emit light individually and at an arbitrary light quantity. Also, the color temperature variable illumination apparatus includes a determination means that determines a light quantity of each of the light sources of the illumination light source such that the color temperature of the illumination light that is irradiated from the illumination light source will be a color temperature corresponding to an operation input that is received by a controller.

The drive means causes each of the light sources to emit light at the light quantity determined by the determination means. Also, the determination means determines the light quantity of each of the light sources such that the difference in a reciprocal color temperature of the illumination light corresponding to an amount of change in the operation input has a proportional relationship to the amount of change in the operation input. Accordingly, in this color temperature variable illumination apparatus, any feeling of unnaturalness regarding the change in the color temperature of the illumination light that is actually recognized relative to the change in the operation input is unlikely to arise.

Here, in general, when a lighting apparatus such as a color temperature variable illumination apparatus is activated, regardless of a value of light quantity and color temperature designated with a controller, an illumination light source is first lighted in an initial state, and is thereafter controlled such that illumination light becomes a designated light quantity and color temperature. The reason for this is to avoid the illumination light source being fully lighten momentarily when an input from the controller is delayed relative to the activation of the lighting apparatus.

However, with the conventional color temperature variable illumination apparatus described above, problems such as described below may arise. For example, in a case where a color temperature of 5000K is designated with the controller, the illumination light source is first lighted in an initial state when the apparatus is activated, and thereafter the illumination light source is controlled such that the color temperature of the illumination light becomes 5000K that is the target color temperature. That is, if the color temperature of the illumination light source in the initial state is assumed to be 2000K, the color temperature of the illumination light source changes from 2000K to 5000K. The color temperature of the illumination light source at the time of activation of the apparatus is thus different from the color temperature of the illumination light source expected by the user, and as a result the user may have a feeling of unnaturalness visually.

SUMMARY OF THE INVENTION

The present technology has been made in view of the above-described problems, and an object of the present technology is to provide a lighting apparatus that can avoid giving the user a feeling of unnaturalness visually at the time of activation of the apparatus, and an illumination system using the lighting apparatus.

A lighting apparatus according to an aspect of the present invention includes a power supply unit and a control unit. The power supply unit is configured to supply lighting power to a load including a light-emitting element. The control unit is configured to control the power supply unit such that, when a command value that is provided from outside changes, a light quantity and a color temperature of the load change according to a first output characteristic defining a correspondence relationship of a plurality of command values to a plurality of light quantities and a plurality of color temperatures. The control unit, at a time of activation of the lighting apparatus, determines a first color temperature of the load at an initial stage of lighting based on a command value that is set in advance before a start of activation of the lighting apparatus, and controls the power supply unit such that the light quantity and the color temperature of the load change according to a second output characteristic during a period in which the color temperature of the load changes from the first color temperature to a second color temperature, in the first output characteristic, corresponding to the command value set in advance. A correspondence relationship between a plurality of light quantities and a plurality of color temperatures defined by the second output characteristic is different from the correspondence relationship defined by the first output characteristic.

An illumination system according to another aspect of the present invention includes the lighting apparatus and the load. The load includes a plurality of light source units each including the light-emitting element, and the plurality of light source units respectively have different color temperatures.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

Figure 1A:
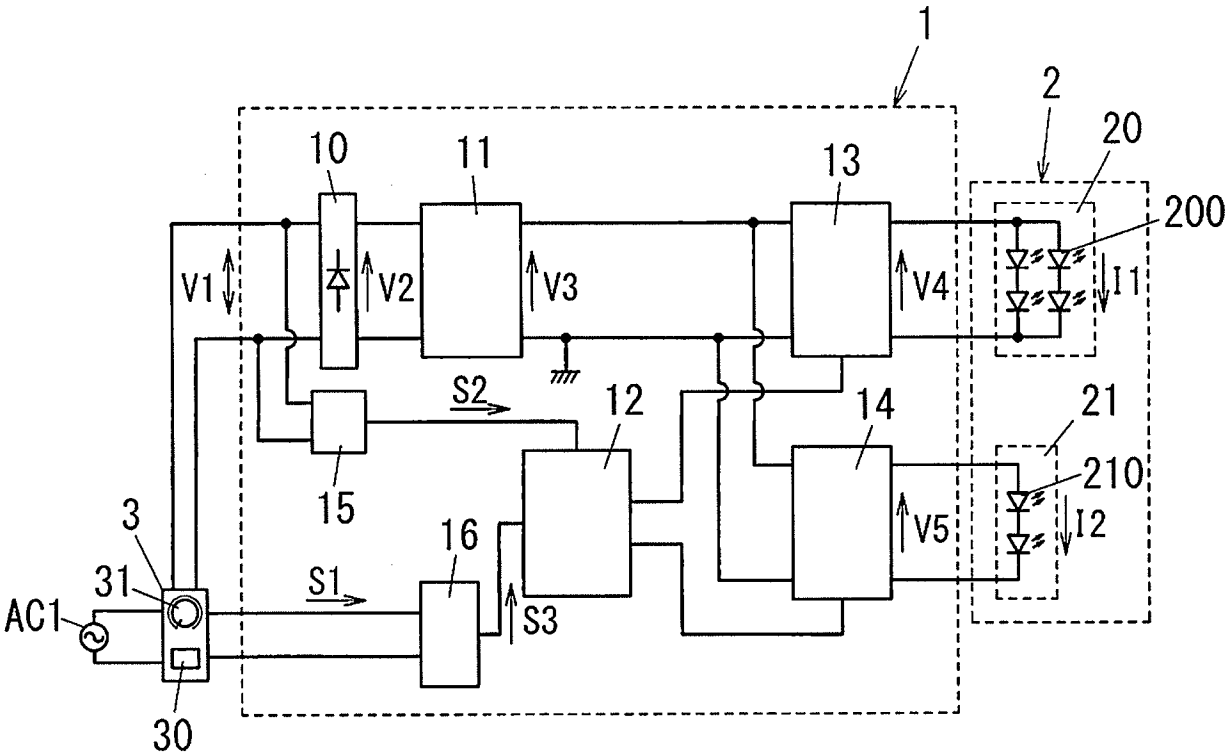
FIG. 1A is a schematic circuit diagram illustrating a lighting apparatus according to an embodiment of the present invention.

A lighting apparatus 1 according to an embodiment of the present invention includes power supply units (first power supply unit 13 and second power supply unit 14). The power supply units supply lighting power to a load 2 that includes light-emitting elements (light-emitting diodes 200 or 210). Also, the lighting apparatus 1 according to the embodiment includes a control unit 12. The control unit 12 controls the power supply units such that, when a command value that is provided from outside is changed, a light quantity and a color temperature of the load 2 change according to a first output characteristic defining a correspondence relationship of a plurality of command values to a plurality of light quantities and a plurality of color temperatures.

The control unit 12 determines, at a time of activation of the lighting apparatus 1, a first color temperature of the load 2 at an initial stage of lighting based on a command value set in advance before the start of activation of the lighting apparatus 1. Thereafter, the control unit 12 controls the power supply units such that the light quantity and the color temperature of the load 2 change according to a second output characteristic during a period in which the color temperature of the load 2 changes from the first color temperature to a second color temperature. The second color temperature is a color temperature, in the first output characteristic, corresponding to the aforementioned command value set in advance. A correspondence relationship between a plurality of light quantities and a plurality of color temperatures defined by the second output characteristic is different from the correspondence relationship defined by the first output characteristic.

In other words, the lighting apparatus 1 according to the embodiment of the present invention includes the power supply units (first power supply unit 13 and second power supply unit 14) that supply lighting power to the load 2 that includes the light-emitting elements (light-emitting diodes 200 or 210), and the control unit 12. The control unit 12 determines, at the start of the lighting apparatus 1, the first color temperature of the load 2 at the initial stage of lighting based on the command value set in advance before the activation of the lighting apparatus 1. Thereafter, the control unit 12 controls the power supply units such that the light quantity and the color temperature of the load 2 change according to the second output characteristic during a period in which the color temperature of the load 2 changes from the first color temperature to the second color temperature. The second color temperature is a color temperature, in the first output characteristic, corresponding to the aforementioned command value set in advance. The control unit 12 controls the power supply units, after the color temperature of the load 2 reaches the second color temperature, such that the light quantity and the color temperature of the load 2 change according to the first output characteristic. The first output characteristic defines a correspondence relationship of a plurality of command values to a plurality of light quantities and a plurality of color temperatures. The second output characteristic defines a correspondence relationship of a plurality of light quantities to a plurality of color temperatures, the correspondence relationship being different from that of the first output characteristic.

In the lighting apparatus 1 according to the embodiment of the present invention, when the lighting apparatus 1 is activated, the control unit 12 determines a color temperature (first color temperature) of the load 2 at the initial stage of lighting based on the command value, and controls the power supply units such that the light quantity and the color temperature of the load 2 change according to the second output characteristic that is different from the first output characteristic. Therefore, in the lighting apparatus 1 according to the embodiment of the present invention, the difference between the target color temperature (second color temperature) of the load 2 and the color temperature at the initial stage of lighting of the load 2 decreases, and it is thus possible to avoid giving the user a feeling of unnaturalness visually.

In the lighting apparatus 1 described above, the control unit 12 may perform the following operation. When the temperature difference between the second color temperature and a third color temperature is a predetermined value or less, the control unit 12 controls, at the activation of the lighting apparatus 1, the power supply units (first power supply unit 13 and second power supply unit 14) such that the light quantity and the color temperature of the load 2 change according to the first output characteristic during a period in which the color temperature of the load 2 changes from the third color temperature to the second color temperature. The third color temperature is a color temperature, in the first output characteristic, corresponding to the minimum light quantity. When the aforementioned temperature difference is larger than the predetermined value, the control unit 12 controls, at the activation of the lighting apparatus 1, the power supply units such that the light quantity and the color temperature of the load 2 change according to the second output characteristic during a period in which the color temperature of the load 2 changes from the first color temperature to the second color temperature.

In the lighting apparatus 1 described above, the control unit 12 may perform the following operation at the activation of the lighting apparatus 1, when the light quantity, in the first output characteristic, corresponding to the aforementioned command value set in advance is a threshold value or less. The control unit 12 controls the power supply units (first power supply unit 13 and second power supply unit 14) such that the light quantity and the color temperature of the load 2 change according to the first output characteristic during a period in which the light quantity of the load 2 changes from the minimum light quantity in the first output characteristic to the light quantity corresponding to the aforementioned command value set in advance.

In the lighting apparatus 1 described above, the control unit 12 may determine, as the first color temperature, a color temperature that is lower than the second color temperature by a predetermined color temperature.

In the lighting apparatus 1 described above, the second output characteristic may satisfy a relationship in which the first color temperature is smaller than the second color temperature.

In the lighting apparatus 1 described above, the temperature difference between the second color temperature and the first color temperature may be smaller than the temperature difference between the second color temperature and the third color temperature. The third color temperature is the color temperature corresponding to the minimum light quantity in the first output characteristic.

In the lighting apparatus 1 described above, the first output characteristic may be characteristic in which light quantity increases with an increase in color temperature.

An illumination system according to the embodiment of the present invention is configured by including the lighting apparatus 1 and the load 2. The load 2 includes the plurality of light source units (first light source unit 20 and second light source unit 21) each including light-emitting elements (light-emitting diodes 200 or 210). The plurality of light source units respectively have different color temperatures.

Hereinafter, the lighting apparatus 1 according to the embodiment of the present invention will be described in detail with reference to the drawings. The lighting apparatus 1 of the present embodiment includes, as shown in FIG. 1A, a rectification unit 10, a power conversion unit 11, the control unit 12, the first power supply unit 13, the second power supply unit 14, a detection unit 15, and a signal input unit 16. The lighting apparatus 1 lights the load 2 by supplying lighting power to the load 2. The load 2 is constituted by the first light source unit 20 and the second light source unit 21 that respectively emit light with different color temperatures.

The lighting apparatus 1 of the present embodiment can be operated by a controller 3. The controller 3 includes a switch 30 for switching on/off electric conduction between a commercial power supply AC1 and the lighting apparatus 1, and a knob 31 for changing the command value for the light quantity and the color temperature of the load 2 by an operation of a user. The controller 3 outputs a command signal that is a PWM (Pulse Width Modulation) signal based on the operation on the knob 31. The duty ratio of the command signal (that is, the command value) can be changed by changing a rotation angle of the knob 31.

Hereinafter, each part of the lighting apparatus 1 of the present embodiment will be described.

The first light source unit 20 is constituted by a plurality of (four, in the diagram) light-emitting diodes 200 that emit light at a low color temperature (2000K, here). Note that although the first light source unit 20 has a configuration in which two sets of light-emitting diodes, one set thereof being a series circuit of the two light-emitting diodes 200, are connected in parallel, as shown in FIG. 1A, the configuration of the first light source unit 20 is not limited thereto.

The second light source unit 21 is constituted by a plurality of (two, in the diagram) light-emitting diodes 210 that emit light at a high color temperature (8000K, here). Note that, although the second light source unit 21 is configured by a series circuit of the two light-emitting diodes 210, as shown in FIG. 1A, the configuration of the second light source unit 21 is not limited thereto. For example, the number of light-emitting diodes 200 in the first light source unit 20 may be the same as the number of light-emitting diodes 210 in the second light source unit 21.

The rectification unit 10 is configured by a diode bridge, for example, converts an alternating-current voltage V1 from the commercial power supply (external power supply) AC1 to a pulsating-current voltage, and outputs the pulsating-current voltage (output voltage V2). The power conversion unit 11 is constituted by an AC/DC converter circuit, for example, converts the output voltage V2 of the rectification unit 10 to a direct-current voltage, and outputs the direct-current voltage (output voltage V3).

The first power supply unit 13 is constituted by a DC/DC converter circuit, for example, converts the output voltage V3 of the power conversion unit 11, and apply a load voltage V4 to the first light source unit 20. A load current I1 thereby flows in each of the light-emitting diodes 200 in the first light source unit 20, and the first light source unit 20 is lighted. The second power supply unit 14 is constituted by a DC/DC converter circuit, for example, converts the output voltage V3 of the power conversion unit 11, and apply a load voltage V5 to the second light source unit 21. A load current I2 thereby flows in each of the light-emitting diodes 210 in the second light source unit 21, and the second light source unit 21 is lighted.

The control unit 12 includes a microcontroller, for example, and executes control for changing the light quantity and the color temperature of the load 2 based on the duty ratio of the command signal S1 from the controller 3. In particular, the control unit 12 controls the load currents I1 and I2 that are respectively supplied to the light source units 20 and 21, by controlling the first power supply unit 13 and the second power supply unit 14 based on the duty ratio of the command signal S1. Accordingly, the control unit 12 controls the light quantity and the color temperature of the load 2 as a whole by controlling a ratio of the light quantities of the light source units 20 and 21 that respectively have different color temperatures.

The detection unit 15 detects the alternating-current voltage V1 that is supplied from the commercial power supply AC1 to the rectification unit 10, and outputs a detection signal S2 indicating a conduction state between the commercial power supply AC1 and the lighting apparatus 1 to the control unit 12. The control unit 12 executes control based on the conduction state between the commercial power supply AC1 and the lighting apparatus 1, by monitoring the detection signal S2. For example, upon determining by the detection signal S2 that conduction between the commercial power supply AC1 and the lighting apparatus 1 is temporarily cut off, the control unit 12 performs control such that the color temperature of the load 2 is a predetermined value. Also, upon determining by the detection signal S2 that conduction between the commercial power supply AC1 and the lighting apparatus 1 is established (that is, the lighting apparatus 1 is activated), the control unit 12 executes control that is performed at the time of activation.

The signal input unit 16 receives an external command signal S1, and converts the command signal S1 to a signal S3 that is appropriate for inputting to the control unit 12. In the lighting apparatus 1 of the present embodiment, the signal input unit 16 receives the command signal S1 from the controller 3.

Figure 2A:
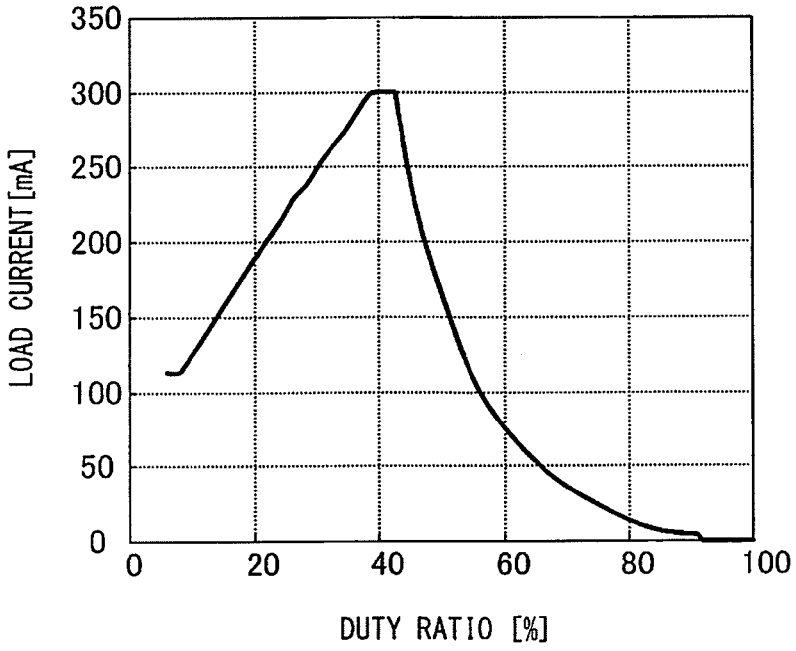
FIG. 2A is a diagram illustrating a correlation between a load current to be supplied to a first light source unit and a duty ratio in the lighting apparatus according to the embodiment of the present invention.
Figure 2B:
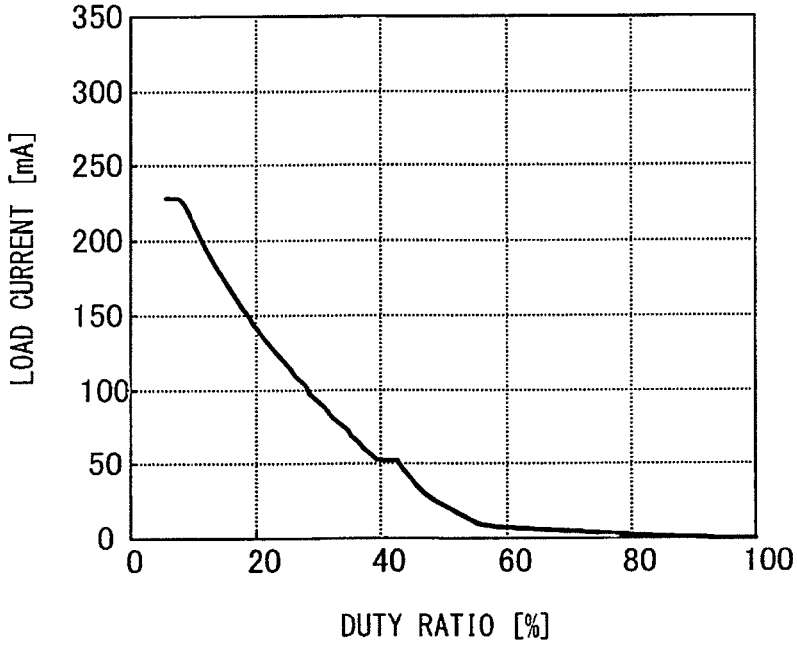
FIG. 2B is a diagram illustrating a correlation between a load current to be supplied to a second light source unit and a duty ratio in the lighting apparatus according to the embodiment of the present invention.

Hereinafter, an operation of the lighting apparatus 1 of the present embodiment will be described with reference to FIGS. 2A and 2B. As shown in FIG. 2A, in a region in which the light quantity of the load 2 is small (in a region in which the duty ratio of the command signal S1 is from 40% to 100%), the control unit 12 controls the first power supply unit 13 such that the load current I1 that is supplied to the first light source unit 20 increases with a decrease in the duty ratio. On the other hand, in a region in which the light quantity of the load 2 is large (in a region in which the duty ratio of the command signal S1 is from 5% to 40%), the control unit 12 controls the first power supply unit 13 such that the load current I1 that is supplied to the first light source unit 20 decreases with a decrease in the duty ratio. Also, as shown in FIG. 2B, the control unit 12 controls the second power supply unit 14 such that the load current I2 that is supplied to the second light source unit 21 increases with a decrease in the duty ratio.

Figure 1B:
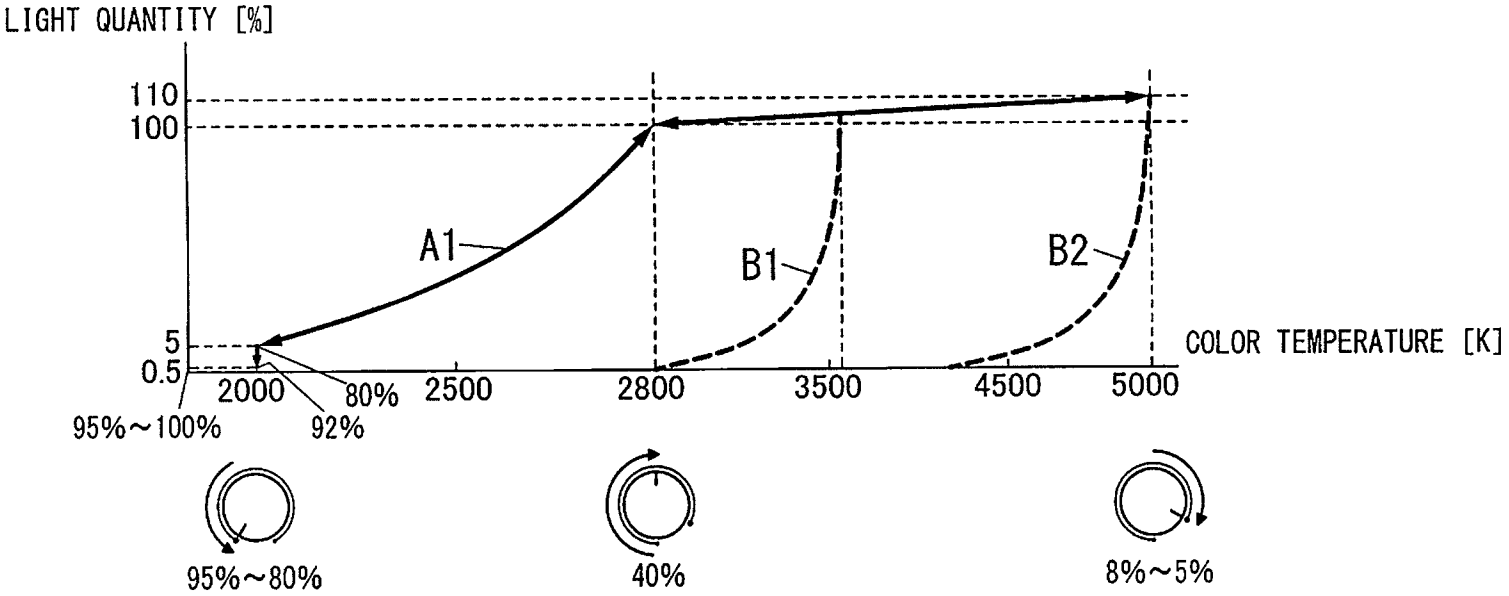
FIG. 1B is an explanatory diagram illustrating operations of the lighting apparatus according to the embodiment of the present invention.

As described above, due to the control unit 12 controlling the power supply units 13 and 14, the light quantity and the color temperature of the load 2 change according to a first output characteristic designated by a solid line A1 in FIG. 1B. Here, the "first output characteristic" defines a correspondence relationship of a command value (duty ratio of command signal) to a light quantity and a color temperature of the load 2. Specifically, assuming the rated light quantity of the load 2 is 100%, in a case where the light quantity changes within a range between 0.5% and 5%, the control unit 12 controls the power supply units 13 and 14 such that the color temperature of the load 2 is constant at 2000K. Also, in a case where the light quantity changes within a range between 5% and 100%, the control unit 12 controls the power supply units 13 and 14 such that the color temperature of the load 2 changes between 2000K and 2800K with an increase/decrease of the light quantity. Also, in a case where the light quantity changes within a range between from 100% and 110%, the control unit 12 controls the power supply units 13 and 14 such that the color temperature of the load 2 changes between 2800K and 5000K with an increase/decrease of the light quantity. That is, when the command value that is provided from the outside is changed, the control unit 12 controls the power supply units 13 and 14 such that the light quantity and the color temperature of the load 2 change according to the first output characteristic. The first output characteristic is a characteristic in which the light quantity increases with an increase in the color temperature. The control unit 12 stores the first output characteristic in advance. That is, the control unit 12 prestores a correspondence relationship of a plurality of command values to a plurality of light quantities and a plurality of color temperatures. Note that the first output characteristic stored in the control unit 12 may be a function that expresses values shown by the solid line A1 in FIG. 1B, or a table in which a light quantity and a color temperature are associated with each of the command values.

For example, in a case where the knob 31 of the controller 3 is rotated to a position at which the duty ratio of the command signal S1 is 95%, when the duty ratio is 80%, the light quantity will be 5% and the color temperature will reach 2000K. When the duty ratio is 92%, the light quantity will be 0.5% and the color temperature will be constant at 2000K. Then, when the duty ratio exceeds 92%, the light quantity will be 0. Also, when the knob 31 of the controller 3 is rotated to a position at which the duty ratio of the command signal S1 is 40%, the light quantity and the color temperature of the load 2 will be 100% and 2800K, respectively. Also, when the knob 31 of the controller 3 is rotated to a position at which the duty ratio of the command signal S1 is 5%, the light quantity and the color temperature of the load 2 will be 110% and 5000K, respectively. Note that, in order to highlight the change of the color temperature of the load 2 in a range from 2000K to 2800K, the horizontal axis of FIG. 1B does not have a linear scale, that is, scale marks of the color temperature are not provided at equal intervals.

Here, in a case where the control unit 12 controls, at the time of activation of the lighting apparatus 1, the power supply units 13 and 14 such that the light quantity and the color temperature of the load 2 change according to the first output characteristic, a problem described below may arise. For example, a case is considered, in which the lighting apparatus 1 is activated in a state in which the light quantity of the load 2 is designated to be 110% by the controller 3. In this case, if the control unit 12 performs control such that the light quantity and the color temperature of the load 2 change according to the first output characteristic, the load 2 is first lighted at the color temperature 2000K, which is considerably lower than the target color temperature 5000K, and thereafter the color temperature of the load 2 reaches the color temperature of the target. Therefore, even though a user expects light that is close to daylight color having a high color temperature, the load 2 is lighted with light that is close to bulb color having a low color temperature, and as a result the user may have a feeling of unnaturalness visually.

Accordingly, in the lighting apparatus 1 of the present embodiment, the control unit 12 controls, when the lighting apparatus 1 is activated, the power supply units 13 and 14 such that the light quantity and the color temperature of the load 2 change according to the second output characteristic. A correspondence relationship of duty ratios of the command signal S1 (command values) to light quantities and color temperatures of the load 2 defined by the second output characteristic is different from the correspondence relationship defined by the first output characteristic. Also, the control unit 12 determines the color temperature (first color temperature) of the load 2 at the initial stage of lighting based on the duty ratio of the command signal S1 (command value) at the time of activation of the lighting apparatus 1. Specifically, in the lighting apparatus 1 of the present embodiment, the control unit 12 controls the power supply units 13 and 14 such that the color temperature of the load 2 at the initial stage of lighting will be a color temperature that is lower than the target color temperature of the load 2 by a predetermined value (800K, here). That is, the control unit 12 determines a color temperature that is lower than the second color temperature (the color temperature, in the first output characteristic, corresponding to the command value that is set before the activation of the lighting apparatus 1) by a predetermined color temperature as the first color temperature at the initial stage of lighting. The second output characteristic satisfies a relationship in which the first color temperature is lower than the second color temperature.

For example, a case is considered, in which the lighting apparatus 1 is activated in a state in which the light quantity of the load 2 is designated to be 105% by the controller 3. Since the target color temperature is 3600K in this case, the control unit 12 determines the color temperature at the initial stage of lighting to be 2800K. Then, the control unit 12 controls the power supply units 13 and 14 such that the load 2 is lighted at a color temperature of 2800K. Thereafter, the control unit 12 controls the power supply units 13 and 14 such that the light quantity and the color temperature of the load 2 change according to the second output characteristic shown by a broken line B1 in FIG. 1B.

Also, a case is considered, in which the lighting apparatus 1 is activated in a state in which the light quantity of the load 2 is designated to be 110% by the controller 3. Since the target color temperature is 5000K in this case, the control unit 12 determines the color temperature at the initial stage of lighting to be 4200K. Then, the control unit 12 controls the power supply units 13 and 14 such that the load 2 is lighted at a color temperature of 4200K. Thereafter, the control unit 12 controls the power supply units 13 and 14 such that the light quantity and the color temperature of the load 2 change according to the second output characteristic shown by a broken line B2 in FIG. 1B.

As described above, in the lighting apparatus 1 of the present embodiment, the control unit 12 controls, when the lighting apparatus 1 is activated, the power supply units 13 and 14 such that the light quantity and the color temperature of the load 2 change according to the second output characteristic that is different from the first output characteristic. Also, the control unit 12 determines a color temperature at the initial stage of lighting of the load 2 based on the command value. Accordingly, the difference between the target color temperature of the load 2 designated by the controller 3 and the color temperature of the load 2 at the initial stage of lighting at the time of activation of the lighting apparatus 1 decreases, and it is thus possible to avoid giving the user a feeling of unnaturalness visually.

Note that, when the light quantity of the load 2 changes within a range between 0.5% and 100%, since the color temperature of the load 2 changes within a range between 2000K and 2800K, a user is unlikely to have a feeling of unnaturalness visually. Then, if the light quantity of the load 2 designated by the command value at the time of activation of the apparatus is a threshold value or less, the control unit 12 may control the power supply units 13 and 14 such that the light quantity and the color temperature of the load 2 change according to the first output characteristic. Here, "the light quantity of the load 2 designated by the command value is a threshold value or less" corresponds to a state in which the light quantity of the load 2 is designated to be 100% or less by the controller 3. That is, in this case, the threshold value is 100%.

In other words, when the temperature difference between the second color temperature and a third color temperature is a predetermined value or less, the control unit 12 performs the following operations at the time of activation of the lighting apparatus 1. The control unit 12 controls, during the period in which the color temperature of the load 2 changes from the third color temperature to the second color temperature, the power supply units 13 and 14 such that the light quantity and the color temperature of the load 2 change according to the first output characteristic. On the other hand, when the above-mentioned temperature difference is larger than the predetermined value, the control unit 12 controls, during the period in which the color temperature of the load 2 changes from the first color temperature to the second color temperature, the power supply units 13 and 14 such that the light quantity and the color temperature of the load 2 change according to the second output characteristic. The second color temperature is a color temperature, in the first output characteristic, corresponding to the command value set in advance before the activation of the lighting apparatus 1. The third color temperature is a color temperature, in the first output characteristic, corresponding to the minimum light quantity.

In this case, the temperature difference between the second color temperature and the first color temperature is less than the temperature difference between the second color temperature and the third color temperature.

Also, in the lighting apparatus 1 of the present embodiment, the second output characteristic satisfies a relationship in which the color temperature at the initial stage of lighting of the load 2 is lower than the color temperature designated by a command value, but the mode of the second output characteristic is not limited thereto.

Incidentally, at the time of activation of the apparatus, due to variability in the control of the power supply units 13 and 14, there is a case where a load current I2 that is supplied to the second light source unit 21 having a high color temperature flows earlier than a load current I1 that is supplied to the first light source unit 20 having a low color temperature. In this case, since the load 2 is momentarily lighted at a color temperature higher than the target color temperature of the load 2 designated by the controller 3, a user may have strong feeling of unnaturalness visually. For example, a case is considered, in which the target color temperature of the load 2 designated by the controller 3 is 3600K. In this case, if the second light source unit 21 is lighted first due to variability in the control of the power supply units 13 and 14 at the time of activation of the apparatus, the load 2 will be lighted at a color temperature of 8000K that is higher than 3600K.

Figure 3:
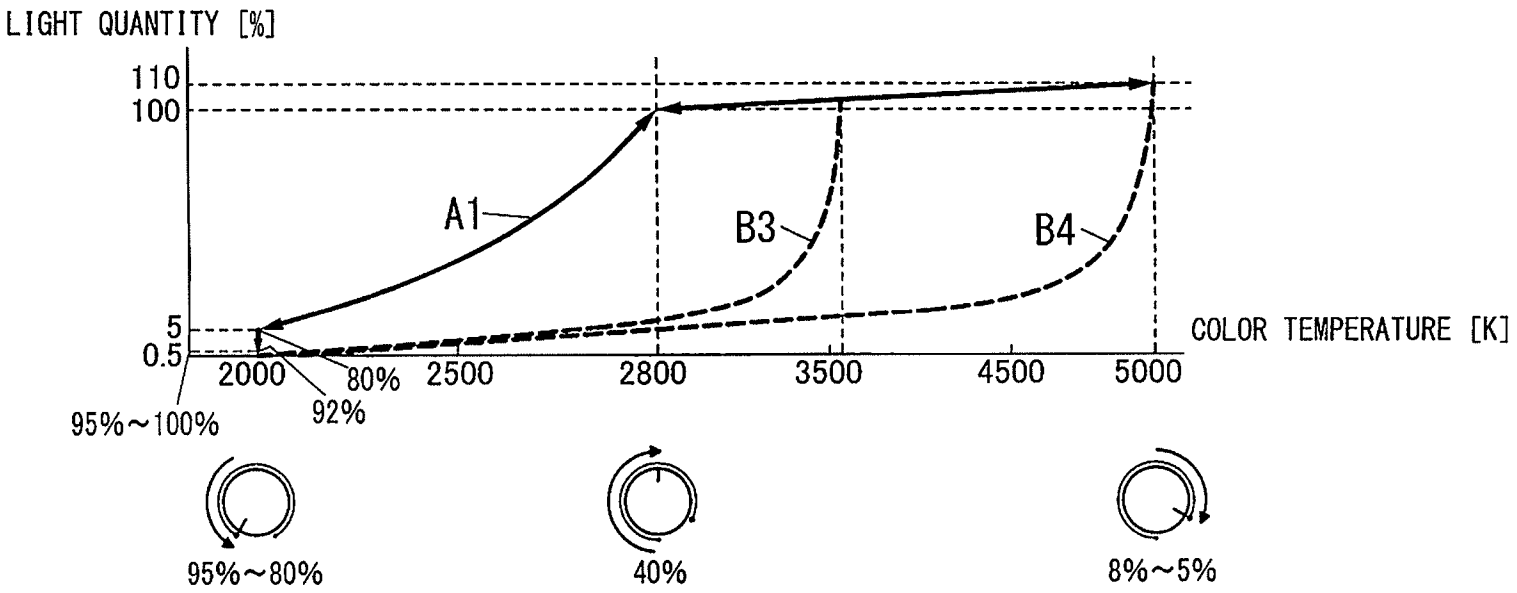
FIG. 3 is an explanatory diagram illustrating operations in another configuration of the lighting apparatus according to the embodiment of the present invention.

Accordingly, the control unit 12 may control, at the time of activation of the apparatus, the power supply units 13 and 14 such that the first light source unit 20 is lighted first and then the second light source unit 21 is lighted. Hereinafter, an operation of the lighting apparatus 1 in this configuration will be described with reference to FIG. 3. For example, a case is considered, in which the lighting apparatus 1 is activated in a state in which the light quantity of the load 2 is designated to be 105% by the controller 3. In this case, the control unit 12 determines the color temperature of the load 2 at the initial stage of lighting to be 2800K. Then, the control unit 12 controls the first power supply unit 13 such that the first light source unit 20 is lighted first at the light quantity of 0.5%, which is the lower limit of dimming. Next, the control unit 12 lights the second light source unit 21 and controls the power supply units 13 and 14 such that the color temperature of the load 2 will be 2800K. Thereafter, the control unit 12 controls the power supply units 13 and 14 such that the light quantity and the color temperature of the load 2 change according to the second output characteristic shown by a broken line B3 in FIG. 3.

Also, a case is considered, in which the lighting apparatus 1 is activated in a state in which the light quantity of the load 2 is designated to be 110% by the controller 3. In this case, the control unit 12 determines the color temperature of the load 2 at the initial stage of lighting to be 4200K. Then, the control unit 12 controls the first power supply unit 13 such that the first light source unit 20 is lighted first at the light quantity of 0.5%, which is the lower limit of dimming. Next, the control unit 12 lights the second light source unit 21 and controls the power supply units 13 and 14 such that the color temperature of the load 2 will be 4200K. Thereafter, the control unit 12 controls the power supply units 13 and 14 such that the light quantity and the color temperature of the load 2 change according to the second output characteristic shown by a broken line B4 in FIG. 3.

In this configuration, even if a variation occurs in controlling the power supply units 13 and 14 at the time of activation of the apparatus, the second light source unit 21 having a high color temperature is lighted after the first light source unit 20 having a low color temperature is lighted. Therefore, this configuration makes it easy to avoid giving a user a feeling of unnaturalness visually at the time of activation of the apparatus. Note that, it is desirable that the control unit 12 controls the power supply units 13 and 14 such that the light quantity of the load 2 is reduced as much as possible until the color temperature of the load 2 reaches the color temperature at the initial stage of lighting.

Here, the illumination system according to the embodiment of the present invention includes the lighting apparatus 1 of any of the embodiments described above, and the load 2. The load 2 is constituted by, for example, the first light source unit 20 and the second light source unit 21, as already described. Obviously, the load 2 may be configured by more light source units. In this case, it is desirable that the light source units respectively have different color temperatures. This configuration can be realized by, for example, using light-emitting elements respectively having different color temperatures for each of the light source units. Also, this configuration can be realized by, for example, using light-emitting elements having the same color temperature for all light source units, and differentiating conversion materials that convert a wavelength of light that is emitted from the light-emitting elements to a different wavelength for each of the light source units. Note that the illumination system of the present embodiment may include a controller 3.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting apparatus comprising:

a power supply unit configured to supply lighting power to a load comprising a light-emitting element; and a control unit configured to control the power supply unit such that, when a command value that is provided from outside changes, a light quantity and a color temperature of the load change according to a first output characteristic defining a correspondence relationship of a plurality of command values to a plurality of light quantities and a plurality of color temperatures, wherein the control unit, at a time of activation of the lighting apparatus, determines a first color temperature of the load at an initial stage of lighting based on a command value that is set in advance before a start of activation of the lighting apparatus, and controls the power supply unit such that the light quantity and the color temperature of the load change according to a second output characteristic during a period in which the color temperature of the load changes from the first color temperature to a second color temperature, in the first output characteristic, corresponding to the command value set in advance, and a correspondence relationship between a plurality of light quantities and a plurality of color temperatures defined by the second output characteristic is different from the correspondence relationship defined by the first output characteristic.

2. The lighting apparatus according to claim 1, wherein, when a temperature difference between the second color temperature and a third color temperature, in the first output characteristic, corresponding to a minimum light quantity is a predetermined value or less, the control unit, at the time of activation of the lighting apparatus, controls the power supply unit such that the light quantity and the color temperature of the load change according to the first output characteristic during a period in which the color temperature of the load changes from the third color temperature to the second color temperature, and wherein, when the temperature difference is larger than the predetermined value, the control unit, at the time of activation of the lighting apparatus, controls the power supply unit such that the light quantity and the color temperature of the load change according to the second output characteristic during a period in which the color temperature of the load changes from the first color temperature to the second color temperature.

3. The lighting apparatus according to claim 1, wherein, the control unit, at the time of activation of the lighting apparatus, controls the power supply unit when a light quantity, in the first output characteristic, corresponding to the command value set in advance is a threshold value or less, such that the light quantity and the color temperature of the load change according to the first output characteristic during a period in which the light quantity of the load changes from a minimum light quantity in the first output characteristic to the light quantity corresponding to the command value set in advance.

4. The lighting apparatus according to claim 1, wherein the control unit is configured to determine, as the first color temperature, a color temperature that is lower than the second color temperature by a predetermined color temperature.

5. The lighting apparatus according to claim 2, wherein the control unit is configured to determine, as the first color temperature, a color temperature that is lower than the second color temperature by a predetermined color temperature.

6. The lighting apparatus according to claim 3, wherein the control unit is configured to determine, as the first color temperature, a color temperature that is lower than the second color temperature by a predetermined color temperature.

7. The lighting apparatus according to claim 1, wherein the second output characteristic satisfies a relationship in which the first color temperature is smaller than the second color temperature.

8. The lighting apparatus according to claim 2, wherein the second output characteristic satisfies a relationship in which the first color temperature is smaller than the second color temperature.

9. The lighting apparatus according to claim 3, wherein the second output characteristic satisfies a relationship in which the first color temperature is smaller than the second color temperature.

10. The lighting apparatus according to claim 4, wherein the second output characteristic satisfies a relationship in which the first color temperature is smaller than the second color temperature.

11. The lighting apparatus according to claim 7, wherein the temperature difference between the second color temperature and the first color temperature is smaller than the temperature difference between the second color temperature and a third color temperature, in the first output characteristic, corresponding to a minimum light quantity.

12. The lighting apparatus according to claim 8, wherein the temperature difference between the second color temperature and the first color temperature is smaller than the temperature difference between the second color temperature and the third color temperature, in the first output characteristic, corresponding to the minimum light quantity.

13. The lighting apparatus according to claim 9, wherein the temperature difference between the second color temperature and the first color temperature is smaller than the temperature difference between the second color temperature and a third color temperature, in the first output characteristic, corresponding to a minimum light quantity.

14. The lighting apparatus according to claim 10, wherein the temperature difference between the second color temperature and the first color temperature is smaller than the temperature difference between the second color temperature and a third color temperature, in the first output characteristic, corresponding to a minimum light quantity.

15. The lighting apparatus according to claim 1, wherein the first output characteristic is a characteristic in which light quantity increases with an increase in color temperature.

16. The lighting apparatus according to claim 2, wherein the first output characteristic is a characteristic in which light quantity increases with an increase in color temperature.

17. The lighting apparatus according to claim 3, wherein the first output characteristic is a characteristic in which light quantity increases with an increase in color temperature.

18. The lighting apparatus according to claim 4, wherein the first output characteristic is a characteristic in which light quantity increases with an increase in color temperature.

19. The lighting apparatus according to claim 7, wherein the first output characteristic is a characteristic in which light quantity increases with an increase in color temperature.

20. An illumination system comprising:

the lighting apparatus according to claim 1; and the load, wherein the load comprises a plurality of light source units each comprising the light-emitting element, and wherein the plurality of light source units respectively have different color temperatures.

* * * * *